US007828133B2

(12) United States Patent
Kadowaki et al.

(10) Patent No.: US 7,828,133 B2
(45) Date of Patent: Nov. 9, 2010

(54) BILL HANDLING DEVICE

(75) Inventors: Minoru Kadowaki, Toyota (JP); Shinji Shibata, Nagoya (JP); Riichi Kato, Nagoya (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 12/260,613

(22) Filed: Oct. 29, 2008

(65) Prior Publication Data

US 2009/0107799 A1 Apr. 30, 2009

(30) Foreign Application Priority Data

Oct. 30, 2007 (JP) ..... 2007-281332

(51) Int. Cl.
*G07F 7/04* (2006.01)

(52) U.S. Cl. ..... 194/206

(58) Field of Classification Search ..... 194/206, 194/207, 350

See application file for complete search history.

(56) References Cited

U.S. PATENT DOCUMENTS

| | | | | |
|---|---|---|---|---|
| 6,823,995 | B2 * | 11/2004 | Mukai | 209/534 |
| 2002/0060421 | A1 | 5/2002 | Kako et al. | |
| 2006/0090983 | A1 * | 5/2006 | Katou et al. | 194/206 |

FOREIGN PATENT DOCUMENTS

| | | | |
|---|---|---|---|
| EP | 1 363 251 | A1 | 11/2003 |
| EP | 1 378 869 | A2 | 1/2004 |
| EP | 1 873 726 | A1 | 1/2008 |
| JP | 08-221636 | A | 8/1996 |
| JP | 3815651 | | 4/2001 |

OTHER PUBLICATIONS

European Search Report and Written Opinion, issued in European Patent Application No. EP 08018900.4-211 dated Jan. 28, 2009.

* cited by examiner

*Primary Examiner*—Stefanos Karmis
*Assistant Examiner*—Mark J. Beauchaine
(74) *Attorney, Agent, or Firm*—McDermott Will & Emery LLP

(57) ABSTRACT

The present invention provides a bill handling device which can realize a reduction in size, an increase in capacity and a reduction in processing time and improves satisfaction of users. The bill handling device includes a bill discriminating portion for discriminating bills, recycle stores for storing bills and separating the bills again, a loading store for supplying bills to the recycle stores or collecting bills from the recycle stores, a reject store and a loading reject store which store reject bills rejected by the bill discriminating portion, and conveying paths for conveying bills to the respective portions, wherein the conveying paths are formed as an annular conveying path which can convey the bills in two directions, and the recycle stores, the loading store, the reject store, and the loading reject store are arranged around the conveying paths.

1 Claim, 5 Drawing Sheets

BILL HANDLING DEVICE

INCORPORATION BY REFERENCE

The present application claims priority from Japanese application JP 2007-281332 filed on Oct. 30, 2007, the content of which is hereby incorporated by reference into the application.

BACKGROUND OF THE INVENTION

1. Field of the Invention

The present invention relates to a bill handling device mounted on an automatic teller machine used in a financial institution and the like.

2. Description of Related Art

Conventionally, a bill handling device is mounted on an automatic teller machine used in a financial institution and the like. This bill handling device includes a bill receiving and dispensing port that has a function of feeding bills having been deposited by a user one by one and a function of discharging bills to be dispensed, a bill discriminating portion that discriminates received bills or bills to be dispensed, a temporary storage portion that temporarily stores received bills, a reject store that stores reject bills discriminated as not meeting a predetermined standard by the bill discriminating portion, a bill store that stores and keeps received bills and feeds the received bills as bills to be dispensed or the like, and a bill conveying path that connects these units.

Recently, according to an increase in kinds of denomination values and an increase in storage capacity, there is provided a bill handling device in which bill stores are arranged side by side in a lower part of the device and other portions are collectively arranged in an upper unit in an upper part of the device (see JP-A-8-221636). In this bill handling device, a bill receiving and dispensing port, a bill discriminating portion, and a temporary storage portion are arranged in the upper unit in the upper part of the device and a plurality of longitudinal bill storages are arranged from the front to the rear in the lower part. In this bill handling device, the respective components are connected by a one-way conveying path.

If the components are connected by the one-way conveying path, the conveying path will be complicated. In particular, since it is necessary to convey received bills and bills to be dispensed in an identical direction inside the bill discriminating portion, it is necessary to form a conveying route of a generally figure 8 shape. Accordingly, the bill receiving and dispensing port and the temporary storage portion are arranged in one loop-like conveying route connected to the bill discriminating portion, and the bill stores are arranged in another loop-like conveying route connected to the bill discriminating portion. Therefore, there are disadvantages that the volume of the structure forming the conveying path increases relative to the entire device and the sizes of the bill stores are reduced relative to the size of the entire device.

On the other hand, there is proposed a cash dispenser in which a bill store (a recycle store) is vertically arranged in a laid state, and which is provided with a two-way conveying path which conveys bills in a vertical direction in a linear manner rather than a loop-like manner (see Japanese Patent No. 3815651). This cash dispenser realizes a reduction in size thereof by including the conveying path that can convey bills in two directions instead of bills being looped.

BRIEF SUMMARY OF THE INVENTION

However, in this configuration, when bills are dispensed from the bill store, reject bills cannot be directly conveyed to the reject store. More specifically, this cash dispenser needs to temporarily store the reject bills in the temporary storage portion (a temporary store) and then convey the reject bills from the temporary storage portion to the reject store. When a loading process is executed for bill supply and the like, the cash dispenser needs to once convey all loaded bills to the temporary storage portion and then store the bills in the bill store. Therefore, conveyance efficiency is low and time required for the loading is twice as long as time necessary for feeding all the bills. This problem also occurs in a collection process. Therefore, this cash dispenser has a problem in that processing time is long.

In view of the problems described above, it is an object of the present invention to provide a bill handling device that can realize all of a reduction in size, an increase in capacity, and a reduction in processing time and to improve satisfaction of users.

The present invention provides a bill handling device including a bill discriminating portion that discriminates bills, a bill storing portion that stores bills and separates the bills again, a bill loading portion that supplies bills to the bill storing portion or collects bills from the bill storing portion, a reject portion that stores reject bills rejected by the bill discriminating portion, and a conveying path for conveying bills to the respective portions, wherein the conveying path is formed as an annular conveying path that can convey the bills in two direction, and the bill storing portion, the bill loading portion, and the reject portion are arranged around the conveying path.

According to the present invention, it is possible to provide a bill handling device that can realize all of a reduction in size, an increase in capacity, and a reduction in operation stop time and to improve satisfaction of users.

Other objects, features and advantages of the invention will become apparent from the following description of the embodiments of the invention taken in conjunction with the accompanying drawings.

DETAILED DESCRIPTION OF THE INVENTION

An embodiment of the present invention will be explained below with reference to the accompanying drawings.

Figure 1:
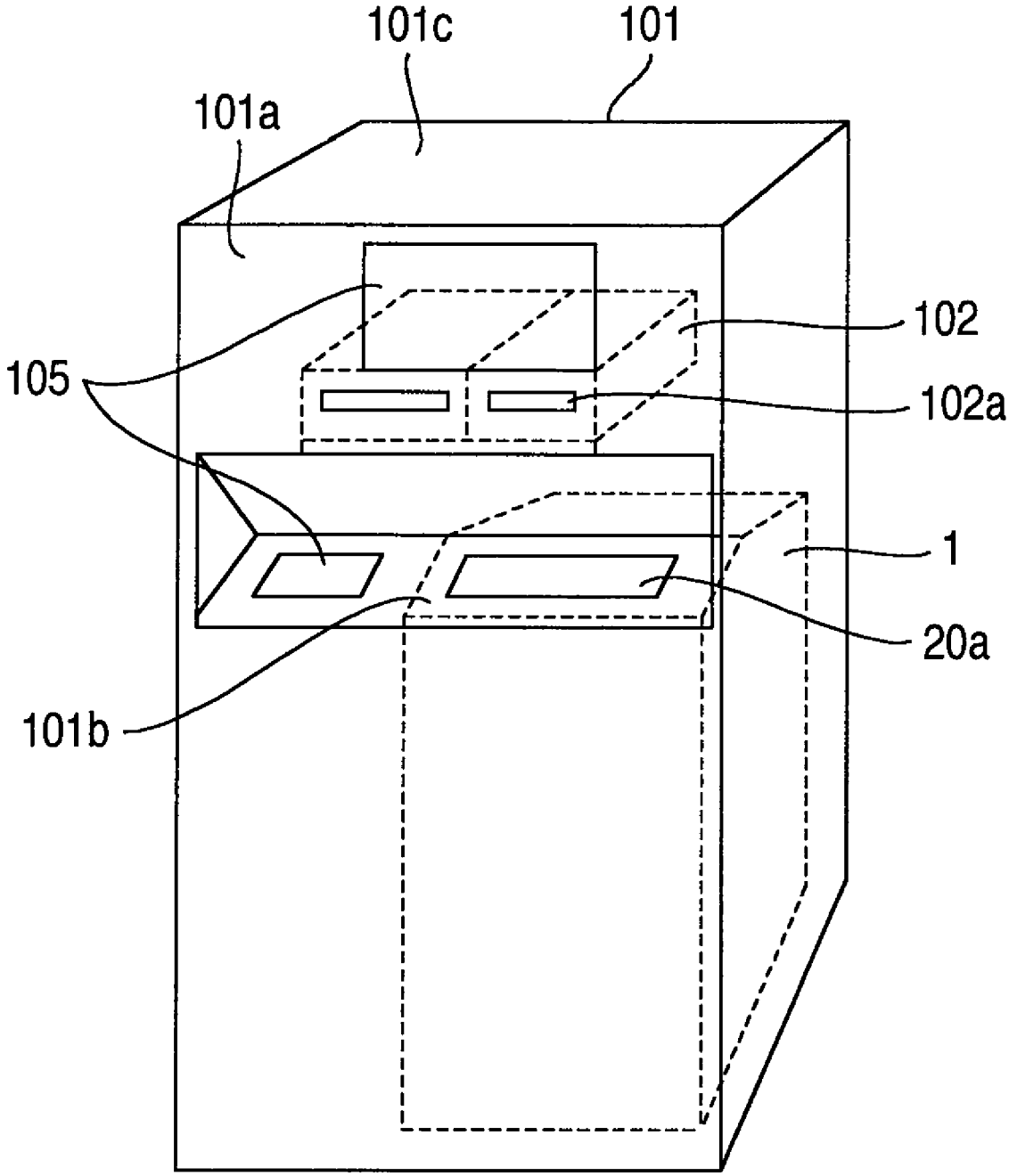
FIG. 1 is a perspective view showing an external appearance of an automatic teller machine.

FIG. 1 is a perspective view of an external appearance of an automatic teller machine.

The automatic teller machine 101 is entirely surrounded by an apparatus housing 101*c*. In the automatic teller machine 101, an upper front plate 101*a* is provided in a front upper part. In the upper front plate 101*a*, a customer operation portion 105 is provided in an upper part. The customer operation portion 105 allows display and input of contents of a transaction.

In the upper front plate 101*a*, a card slot 102*a* is provided on a lower right side of the customer operation portion 105. In the automatic teller machine 101, a card and statement processing mechanism 102 is provided in the inside of the card slot 102*a* section. The card and statement processing mechanism 102 communicates with the card slot 102*a*, processes a card of a user inserted from the card slot 102*a*, and prints and discharges a transaction detailed statement.

In the automatic teller machine 101, a front plate 101*b* inclined toward the front is provided in the front at a center position of its height. In the front plate 101*b*, the customer operation portion 105 is provided on the left side and a shutter 20*a* for a receiving and dispensing port is provided on the right side. The customer operation portion 105 allows display and input of contents of a transaction.

In the automatic teller machine 101, a bill handling device 1 is provided as a cash dispenser in the inside in a right part. In the bill handling device 1, the receiving and dispensing port communicates with the shutter 20*a* for processing bills.

The automatic teller machine 101 configured in this way receives processes such as deposit, payment, and transfer by a user in a customer attending section on a front surface, and executes these kinds of processes. The automatic teller machine 101 uses a card, bills, and a detailed statement as media.

Figure 2:
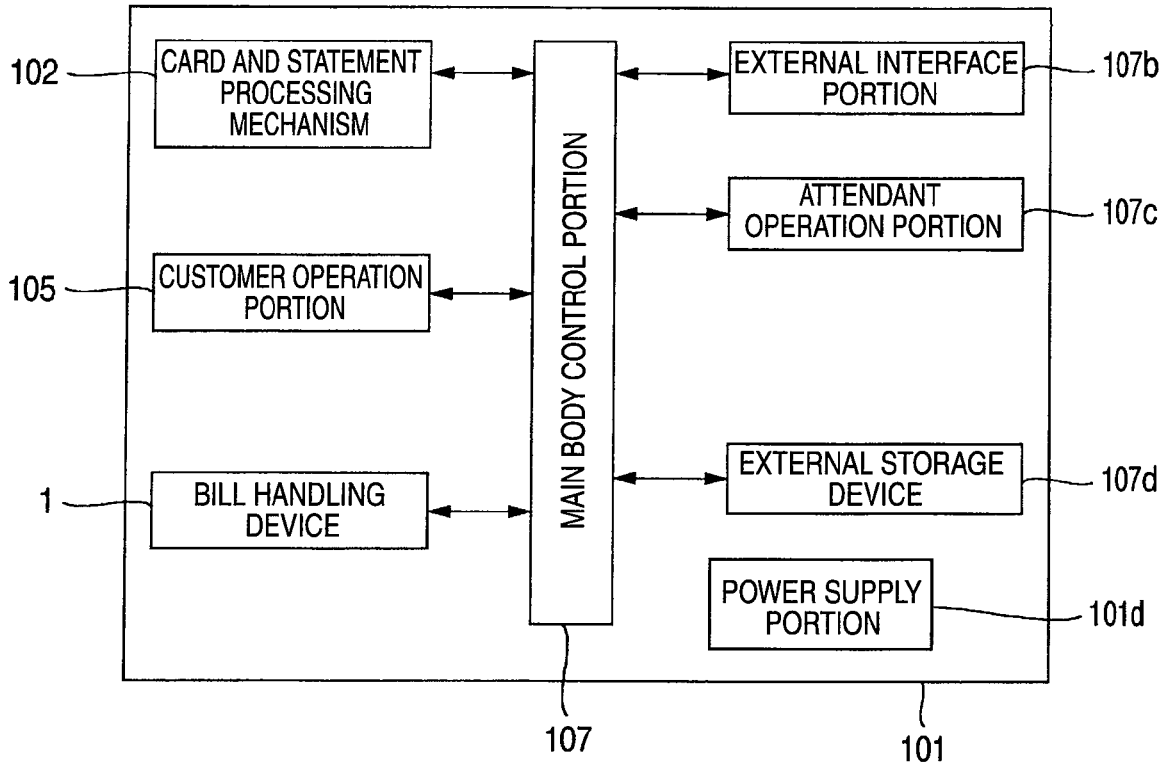
FIG. 2 is a control block diagram showing control relation of the automatic teller machine.

FIG. 2 is a control block diagram of a control relation of the automatic teller machine 101.

The card and statement processing mechanism 102, the bill handling device 1, and the customer operation portion 105 housed in the automatic teller machine 101 are connected to a main body control portion 107 by lines such as a USB. The card and statement processing mechanism 102, the bill handling device 1, and the customer operation portion 105 perform necessary operations under the control by the main body control portion 107. In the main body control portion 107, an external interface portion 107*b*, an attendant operation portion 107*c*, and an external storage 107*d* are connected by bus connection or the like. The main body control portion 107 exchanges necessary data with the external interface portion 107*b*, the attendant operation portion 107*c*, and the external storage 107*d*. Reference sign 101*d* denotes a power supply portion that supplies electric power to the respective mechanical portions and components.

Figure 3:
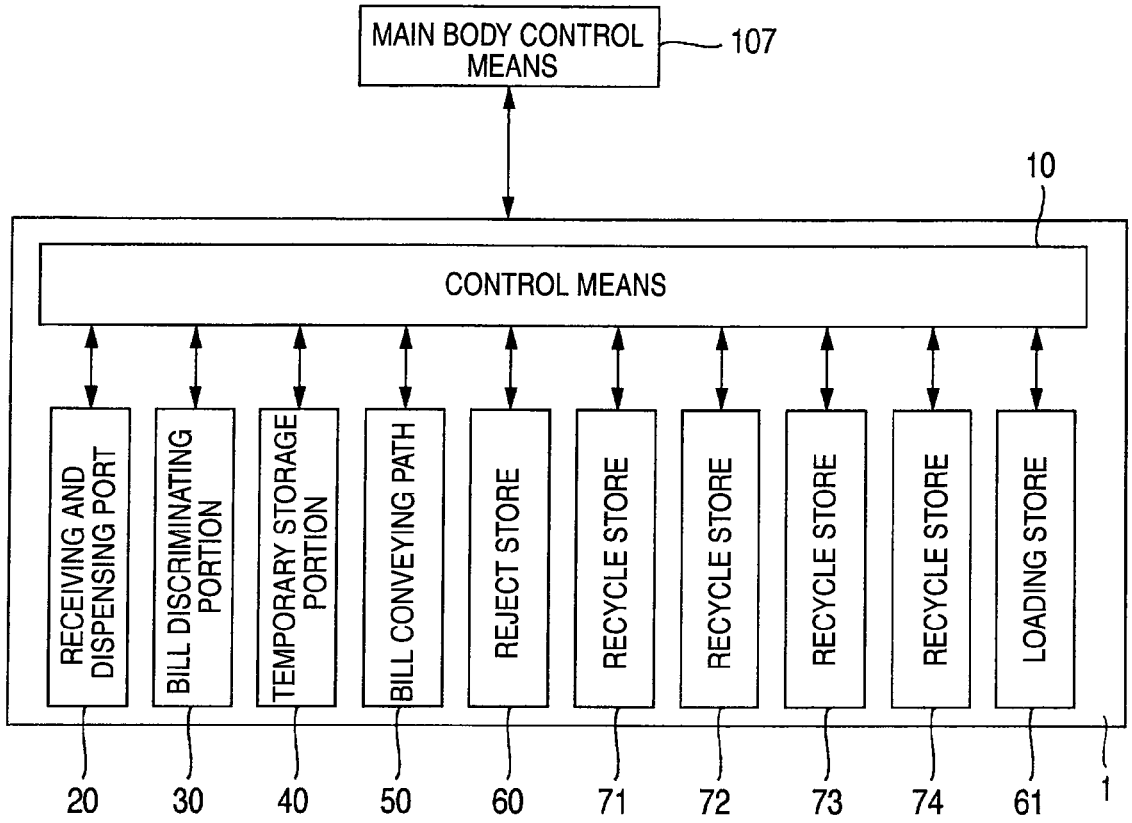
FIG. 3 is a control block diagram showing control relation of a bill handling device.

FIG. 3 is a control block diagram of a control relation of the bill handling device 1 arranged in the automatic teller machine 101.

A control portion 10 of the bill handling device 1 is connected to the main body control portion 107 of the automatic teller machine 101 via a line. The control portion 10 performs control of the bill handling device 1 according to a command from the main body control portion 107 and detection of a state of the bill handling device 1. The control portion 10 sends the state of the bill handling device 1 to the main body control portion 107 when necessary.

The bill handling device 1 also includes a driving motor, an electromagnetic solenoid, a sensor and the like (not shown in the figure) for each unit (a bill receiving and dispensing port 20 as a bill receiving and dispensing portion, a bill discriminating portion 30, a temporary storage portion 40, conveying paths 51*a* to 58, a reject store 60 operating as an operation reject store, and recycle stores 71 to 74 as bill storing portions). The bill handling device 1 controls the drive of actuators (the driving motor, the electromagnetic solenoid, etc.) according to a transaction described later while monitoring the state with a sensor.

Figure 4:
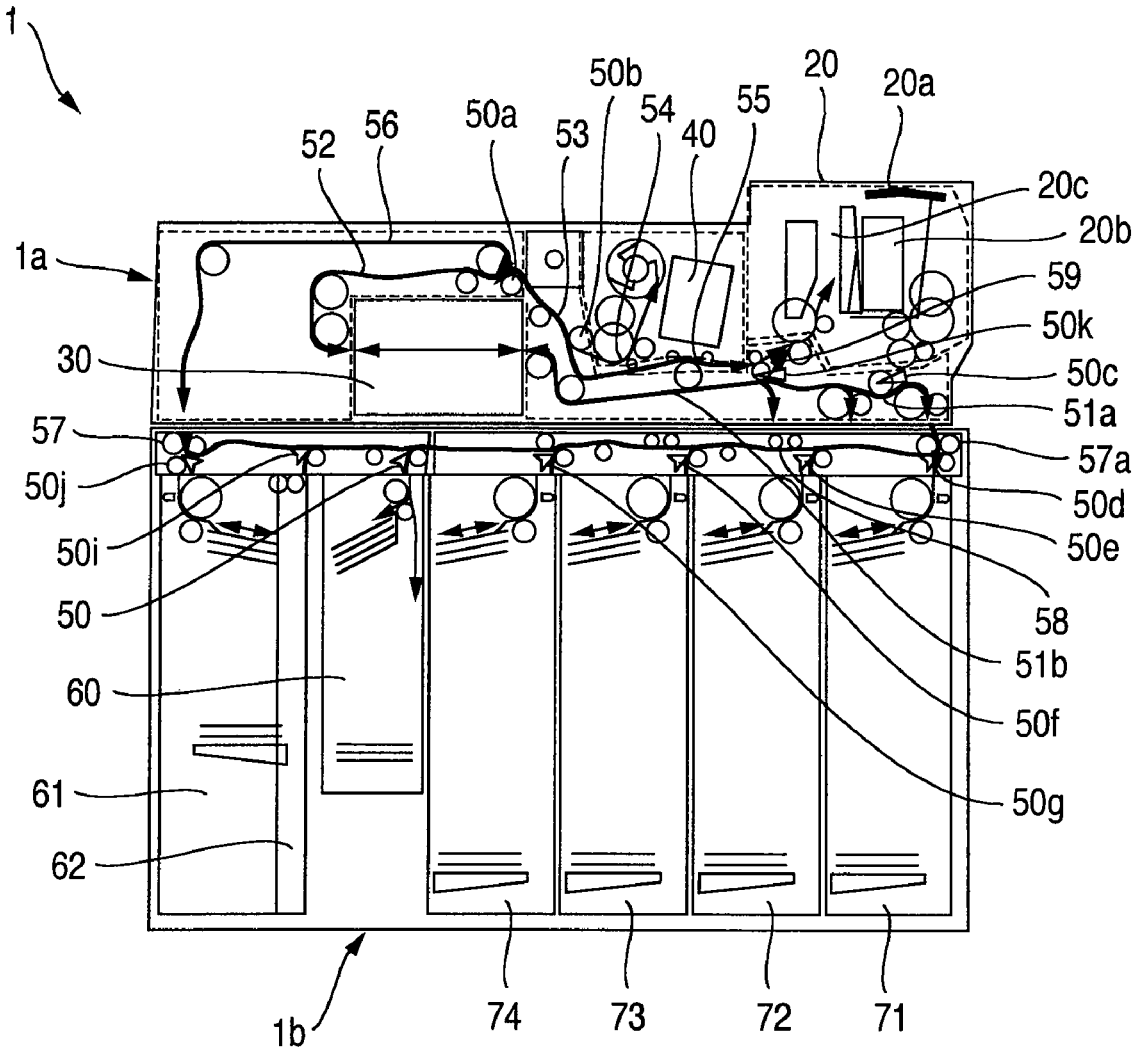
FIG. 4 is a side view showing a configuration of the bill handling device.

FIG. 4 is a side view of a configuration of the bill handling device 1.

The bill handling device 1 roughly includes an upper bill mechanism 1*a* and a lower bill mechanism 1*b*.

In the upper bill mechanism 1*a*, mechanisms necessary for exchange of bills with users are mainly collected. The upper bill mechanism 1*a* includes the bill receiving and dispensing port 20 through which the users input and extract bills, the bill discriminating portion 30 that discriminates bills, the temporary storage portion 40 in which the received bills are temporarily stored until the transaction is concluded, and the control portion 10. In FIG. 4, the control portion 10 is not shown. The temporary storage portion 40 includes a space for temporarily storing bills and a conveying roller, an impeller, and the like for accumulating bills in the space. As indicated by a dotted line in the figure, the temporary storage portion 40 is formed as a unit.

The upper bill mechanism 1*a* will be explained in detail. The bill receiving and dispensing port 20 is arranged on the front side serving as a customer attending section. The temporary storage portion 40 is arranged behind the bill receiving and dispensing port 20 to be adjacent thereto. The bill discriminating portion 30 is arranged behind the temporary storage portion 40 to be slightly apart from the temporary storage portion 40. The bill discriminating portion 30 can discriminate denominations and the truth of bills regardless of whether the bills are conveyed from the front to the back or conveyed from the back to the front. In other words, the bill discriminating portion 30 can discriminate denominations and the truth of bills conveyed in the two directions and can discriminate whether the bills should be rejected.

In the bill receiving and dispensing port 20, a bill feeding portion 20*b* that feeds bills, which have been input from above in an open state of the shutter 20 in the upper part, downward and a bill accumulating portion 20*c* that accumulates bills conveyed from below are arranged in the front and the rear in this order.

A lower end of the bill feeding portion 20*b* and a front surface of the bill discriminating portion 30 are connected by a conveying path 51*a* and a conveying path 51*b* that extend in a front-rear direction. A bill distribution gate 50*c* as a branching portion for distributing bills to a lower bill mechanism 1*b* is provided along the conveying path 51*a*.

A rear surface of the bill discriminating portion 30 is connected to a rear lower part of the temporary storage portion 40 by conveying paths 52, 53, and 54. The conveying path 52 once rises substantially from the center in a vertical direction of the rear surface of the bill discriminating portion 30, extends substantially horizontally to the front above the bill discriminating portion 30, and is connected to a bill distribution gate 50*a* serving as a branching portion provided in an upper position near the front surface of the bill discriminating portion 30.

The bill distribution gate 50*a* is arranged in a position behind and above the temporary storage portion 40, which is a position as close as possible to the back of the temporary storage portion 40. Viewed from the bill discriminating portion 30, the bill distribution gate 50*a* is arranged in a near position in the front above the bill discriminating portion 30.

The conveying path 53 extends in an oblique front downward direction from the bill distribution gate 50*a* and is connected to a bill distribution gate 50*b* provided behind and below the temporary storage portion 40. The conveying path 54 connects the bill distribution gate 50*b* to the temporary storage portion 40.

The bill distribution gate 50*b* is connected to a lower end of the bill accumulating portion 20*c* by a conveying path 55. The conveying path 55 extends substantially horizontally in the front-rear direction. Therefore, a rear part of the bill discriminating portion 30 is connected to the bill accumulating portion 20*c* by the conveying paths 52, 53, and 55.

The bill distribution gate 50*a* is connected to a backside of the device by a conveying path 56. The conveying path 56 extends substantially horizontally backward from the bill distribution gate 50*a*, then, extends in a downward direction, and is connected to the lower bill mechanism 1*b* in a delivering portion 57*b*.

In the lower part of the bill distribution gate 50*c* provided along the conveying path 51*a* that connects the bill receiving and dispensing port 20 and the bill discriminating portion 30, the delivering portion 57*a* that delivers bills to and receives bills from the lower bill mechanism 1*b* is provided.

A bill distribution gate 50*k* is provided between the conveying path 51*a* and the conveying path 51*b*. A conveying path 59 that connects the bill distribution gate 50*k* and the bill accumulating portion 20*c* is also provided. This makes it possible to store bills conveyed in both front and rear directions through the bill discriminating portion 30 for discrimination in the bill accumulating portion 20*c* of the bill receiving and dispensing port 20.

Among these conveying paths, at least the conveying paths 51*a*, 51*b*, 52, 53, 54, and 56 are two-way conveying paths that can convey bills in both of a direction from an upstream side to a downstream side and a direction from the downstream side to the upstream side.

In this way, from the upstream side to the downstream side, the bill feeding portion 20*b* of the bill receiving and dispensing port 20, the conveying paths 51*a* and 51*b*, the bill discriminating portion 30, the conveying path 52, the bill distribution gate 50*a*, the conveying path 53, the bill distribution gate 50*b*, the conveying path 55, and the bill accumulating portion 20*c* are connected in this order.

Recycle stores 71 to 74 for storing received bills separately in respective denominations and feeding the bills again are provided in the lower bill mechanism 1*b*. A reject store 60 for storing bills not to be recycled is mounted on the lower bill mechanism 1*b*. Moreover, a loading store 61 that loads bills in the recycle stores, collects the bills and functions as a bill loading portion can be mounted on the lower bill mechanism 1*b*.

The loading store 61 has a loading reject store 62 for storing reject bills rejected during loading. A conveying path 58 is provided above the recycle stores 71 to 74, the reject store 60, the loading store 61, and the loading reject store 62.

The conveying path 58 is connected to the delivering portions 57*a* and 57*b* provided in a lower part of the upper bill mechanism 1*a*. Bills can be conveyed in two directions by the conveying path 58. The conveying path 58 extends substantially horizontally in the front-rear direction. Bill distribution gates 50*d* to 50*j* for distributing bills that should be stored in the recycle stores 71 to 74, the reject store 60, the loading store 61, and the loading reject store 62 are provided above the respective stores.

Each of the loading store 61 and the recycle stores 71 to 74 can deliver bills to and receive bills from the conveying path 58 in one place. The loading store 61 and the recycle stores 71 to 74 are connected to the conveying path 58 by two-way conveying paths. In the reject store 60, a bill distribution gate 50*h* and a reject store inlet are formed such that bills conveyed from both of the front and the rear of the device can be stored therein.

In particular, the bill distribution gate 50*h* can be switched to three states, i.e., a state in which bills directly pass through the conveying path 58, a state in which bills conveyed from the front of the device are stored in the reject store 60, and a state in which bills conveyed from the rear of the device are stored in the reject store 60. The bill distribution gate 50*h* may be switched to two states, i.e., a state in which bills directly pass through the conveying path 58 and a state in which bills conveyed from both of the front and the rear of the device are stored in the reject store 60. It is also possible that two bill distribution gates are provided in the front and the rear instead of the bill distribution gate 50*h*, one bill distribution gate is used when bills conveyed from the front of the device are stored in the reject store 60, the other bill distribution gate is used when bills conveyed from the rear of the device are stored in the reject store 60, and both of the bill distribution gates are retracted when bills are caused to pass without being stored in the reject store 60.

The loading reject store 62 is configured to be capable of storing bills conveyed from the front of the device. The loading reject store 62 may be configured to be capable of storing bills conveyed from the rear in the same manner.

The bill discriminating portion 30 and the two-way conveying paths 51*a*, 51*b*, 52, 56, and 58 provided in the device become a bidirectional annular conveying path having the bill discriminating portion.

The bill discriminating portion 30 is connected to a post stage of the bill feeding portion 20*b* of the bill receiving and dispensing port 20. The temporary storage portion 40 is connected to a post stage of the bill discriminating portion 30. The reject store 60, the loading store 61, the loading reject store 62, and the recycle stores 71 to 74 are connected to a post stage of the temporary storage portion 40.

The bill discriminating portion 30 is connected to a post stage of the recycle stores 71 to 74. The temporary storage portion 40, the bill accumulating portion 20*c* of the bill receiving and dispensing port 20, the reject store 60, the loading store 61, and the loading reject store 62 are connected to a post stage of the bill discriminating portion 30 in parallel to one another. In this route, the conveying paths 52 and 53 in a part of the route connected to the temporary storage portion 40 and the bill accumulating portion 20*c* are used in common. The conveying paths 52 and 56 in a part of the route connected to the reject store 60, the loading store 61, and the loading reject store 62 are used in common.

The bill distribution gates 50*d* to 50*g* and the bill distribution gate 50*j* operate as branching and merging portions. The bill distribution gate 50*h* functions as an operational reject branching and merging portion. The bill distribution gate 50*i* functions as a loading reject branching and merging portion.

Operations of the bill handling device 1 during a receipt transaction process will be explained below.

In the receipt transaction process, first, a receipt counting process for performing truth discrimination, denomination discrimination, and counting of bills input to the bill feeding portion 20*b* of the bill receiving and dispensing port 20 is executed.

In this receipt counting process, the bill feeding portion 20*b* of the bill receiving and dispensing port 20 separates the received plural bills one by one and feeds the bills downward. The bills fed downward from the bill feeding portion 20*b* are conveyed backward substantially horizontally by the conveying paths 51*a* and 51*b* and pass through the bill discriminating portion 30 from the front side to the rear side. The bill discriminating portion 30 discriminates, using a sensor or the like mounted therein, truth, denominations, and normal and damaged states of the passing bills.

The bills having passed through the bill discriminating portion 30 are once conveyed upward from the rear surface of the bill discriminating portion 30 by the conveying path 52 and conveyed to the front side substantially horizontally. While the bills are conveyed by the conveying path 52, the discrimination by the bill discriminating portion 30 is completed and switching of the bill distribution gates 50*a* and 50*b* is executed according to a result of the discrimination.

When the bill discriminating portion 30 discriminates that the bills are acceptable bills, the bill distribution gates 50*a* and 50*b* are switched to connect the bill discriminating portion 30 and the temporary storage portion 40. The bills are conveyed forward by the conveying paths 53 and 54 and accumulated in the temporary storage portion 40.

When the bill discriminating portion 30 discriminates that the bills are unacceptable bills, the bill distribution gates 50*a* and 50*b* are switched to connect the bill discriminating portion 30 and the bill accumulating portion 20*c* provided in the bill receiving and dispensing port 20. The bills are conveyed by the conveying paths 53, 54, and 55, accumulated in the bill accumulating portion 20*c*, and returned to a payer.

In the receipt counting process described above, the conveying paths 51*a*, 51*b*, 52, 53, 54, and 55 operate to convey the bills in a first conveying direction.

All bills inputted to the bill receiving and dispensing port 20 are processed in this way. When a received amount and an amount counted by the bill handling device 1 coincide with each other and the user decides receipt transaction on the customer operation portion 105 (see FIG. 2), a storage process for storing the bills, which are temporarily stored in the temporary storage portion 40, in the recycle stores 71 to 74 is executed.

In this storage process, first, the bill distribution gates 50*a* and 50*b* are switched to connect the temporary storage portion 40 and the bill discriminating portion 30. The bill distribution gate 50*c* is switched to connect the bill discriminating portion 30 and the conveying path 58 of the lower bill mechanism 1*b*.

The bills fed one by one by the temporary storage portion 40 are conveyed to the bill discriminating portion 30 through the conveying path 54, the bill distribution gate 50*b*, the conveying path 53, the bill distribution gate 50*a*, and the conveying path 52. The bills having passed through the bill discriminating portion 30 are conveyed by the conveying paths 51*b* and 51*a* and conveyed to the lower bill mechanism 1*b* by the bill distribution gate 50*c* through the conveying path 57*a*. The bills are conveyed by the conveying path 58 of the lower bill mechanism 1*b*, distributed by the bill distribution gates 50*d* to 50*h*, which are switched according to denominations or the like, and stored in the reject store 60 and any one of the recycle store 71 to 74.

When the bill handling device 1 is configured to discriminate denominations and the like of the bills with the bill discriminating portion 30 during this storage process and switch the bill distribution gates 50*d* to 50*h* according to a result of the discrimination, it is possible to complete the discrimination and switch the bill distribution gates 50*d* to 50*h* while the bills are conveyed by the conveying paths 51*b*, 51*a*, and 58.

In the storage process described above, the conveying paths 54, 53, 52, 51*b*, 51*a*, 57*a*, and 58 operate to convey the bills in a second conveying direction opposite to the first conveying direction.

Next, operations executed by the bill handling device 1 in a dispensing transaction process will be explained below.

In the dispensing transaction process, the bills are fed from the respective recycle stores 71 to 74 one by one every denomination until the number of bills reaches a predetermined number. The fed bills are conveyed to the bill discriminating portion 30 by the conveying paths 58, 57*a*, 51*a*, and 51*b*.

The bill discriminating portion 30 judges whether the bills passing through the bill discriminating portion 30 are bills that can be dispensed.

When the bills can be dispensed, the bill distribution gates 50*a* and 50*b* are switched to connect the bill discriminating portion 30 and the bill accumulating portion 20*c*. The bills are conveyed to the bill accumulating portion 20*c* by the conveying paths 52, 53, and 55 and accumulated in the bill accumulating portion 20*c*.

When the bills cannot be dispensed, the bill distribution gate 50*a* is switched to connect the bill discriminating portion 30 and the conveying path 56. The bills are conveyed to the reject store 60 mounted on the lower bill mechanism 1*b* through the conveying paths 56 and 58. The discrimination and the switching of the bill distribution gate 50*a* according to a result of the discrimination are completed while the bills are conveyed by the conveying path 52.

When the operation for conveying the bills is finished in this way, the shutter 20*a* of the bill receiving and dispensing port 20 is opened. The user can extract the bills accumulated in the bill accumulating portion 20*c*. When the bills are extracted by the user, the shutter 20*a* is closed and the dispensing transaction process is finished.

In the operations of the dispensing transaction process described above, the conveying paths 58, 57*a*, 51*a*, 51*b*, 52, 53, 55, and 56 operate to convey the bills in the first conveying direction.

Operations of a loading process for loading bills in the recycle stores 71 to 74 from the loading store 61 and operations of a collection process for collecting bills in the loading store 61 from the recycle stores 71 to 74 will be explained below.

In the loading process, the bills fed one by one from the loading store 61 are conveyed to the delivering portion 57*b* through the conveying path 58, passed to the upper bill mechanism 1*a*, and conveyed to the bill discriminating portion 30 through the conveying paths 56 and 52. The bill discriminating portion 30 discriminates whether the bills are deserved to be loaded. Thereafter, the bills are passed to the conveying path 58 of the lower bill mechanism 1*b* through the conveying paths 51*b* and 51*a* and the delivering portion 57*a*. The bills are distributed by the bill distribution gates 50*d* to 50*h*, which are switched according to denominations, and stored in any one of the recycle stores 71 to 74. Bills judged to be rejected by the bill discriminating portion 30 are switched by the bill distribution gate 50*i* and stored in the loading reject store 62.

In the operation of the loading process described above, the conveying paths 58, 57*b*, 56, 52, 51*b*, 51*a*, and 57*a* operate to convey the bills in the second conveying direction.

In the collection process, the bills fed from the recycle stores 71 to 74 are conveyed to the bill discriminating portion 30 through the conveying path 58, the delivering portion 57*a*, and the conveying paths 51*a* and 51*b*. Thereafter, the bills are conveyed to the loading store 61 through the conveying paths 52 and 56 and the delivering portion 57*b* and stored therein. However, the bills discriminated to be rejected by the bill discriminating portion 30 are switched by the bill distribution gate 50*j*, conveyed to the reject store 60 side, distributed by the bill distribution gate 50*h*, and stored in the reject store 60. The reject store 60 and the bill distribution gate 50*h* are configured to be capable of storing bills, whether the bills are conveyed from the front side or the rear side of the device as described above.

In the operation of the collection process described above, the conveying paths 58, 57*a*, 51*a*, 51*b*, 52, 56, and 57*b* operate to convey the bills in the first conveying direction.

By the configuration and the operations described above, an annular conveying path is formed by the bill discriminating portion 30 and the two-way conveying paths 51*a*, 51*b*, 52, 56, and 58 connected to the bill discriminating portion 30. A simple conveying path configuration for connecting the bill recycle stores 71 to 74, the reject store 60, the bill receiving and dispensing port 20, and the temporary storage portion 40 to the conveying paths is realized. This makes it possible to configure a device with a minimum number of conveying paths and provide the bill handling device 1 that meets the demand for a reduction in size and an increase in capacity.

In addition, it is unnecessary to form the conveying route having a figure 8 shape as in the past. Therefore, it is possible to simplify the conveying path.

In the collection process for collecting bills in the loading store 61 from the bill recycle stores 71 to 74, the bills are conveyed in the first conveying direction. In the loading process for loading bills in the bill recycle stores 71 to 74 from the loading store 61, the bills are conveyed in the second conveying direction. Consequently, in the collection process, the bills can be conveyed from the bill recycle stores 71 to 74 to the bill discriminating portion 30 and the loading store 61 in this order. In the loading process, the bills can be conveyed from the loading store 61 to the bill discriminating portion 30 and the bill recycle stores 71 to 74 in this order. Therefore, it is possible to execute the operations for discriminating bills and collecting or loading the bills, by performing useful and efficient conveyance.

The reject store 60 is connected to the conveying path 58 by the bill distribution gate 50*h* that can store the bills from both first and second conveying directions. Therefore, it is possible to set a conveying direction in the collection process and a conveying direction in the loading process to be opposite, and realize useful and efficient conveyance.

The bill recycle stores 71 to 74 and the loading store 61 are respectively connected to the conveying path 58 by the bill distribution gates 50*d* to 50*g* and the bill distribution gate 50*j*, each of which is provided in one place. Therefore, it is possible to simplify the structure as much as possible.

In the dispensing transaction process, reject bills that cannot be dispensed to the bill accumulating portion 20*c* can be directly conveyed to the reject store 60 by switching the bill distribution gate 50*a*. In other words, it is unnecessary to temporarily store the bills in the temporary storage portion 40 and the bills can be efficiently processed.

In the loading process, it is unnecessary to temporarily store bills in the temporary storage portion 40. The bills can be directly stored in one of the recycle stores 71 to 74 from the loading store 61 through the bill discriminating portion 30. It is also unnecessary to temporarily store bills judged to be rejected by the bill discriminating portion 30 in the temporary storage portion 40. The reject bills can be directly stored in the loading reject store 62.

In the collection process, it is unnecessary to temporarily store bills in the temporary storage portion 40. The bills can be directly stored in the loading store 61 from the recycle stores 71 to 74 through the bill discriminating portion 30. It is also unnecessary to temporarily store bills judged to be rejected by the bill discriminating portion 30 in the temporary storage portion 40. The reject bills can be directly stored in the reject store 60.

An exclusive conveying path for directly conveying bills from the temporary storage portion 40 to the bill discriminating portion 30 is unnecessary. Therefore, it is possible to simplify the structure of the conveying path.

Even when the bills are conveyed in the second conveying direction which is opposite to the first conveying direction, the bills pass through the bill discriminating portion 30. Therefore, it is possible to discriminate and process all denominations.

In the receipt counting, the bills do not pass through the conveying path 58 of the lower bill mechanism 1*b*. Therefore, is it possible to clearly distinguish customer bills and bank bills even if a trouble such as a jam occurs. In other words, the bill handling device 1 stores the received customer bills in the upper bill mechanism 1*a* until the process is decided and conveys the customer bills to the lower bill mechanism 1*b* as bank bills after the process is decided. Therefore, the bills present in the upper bill mechanism 1*a* can be clearly distinguished as customer bills and the bills present in the lower bill mechanism 1*b* can be clearly distinguished as bank bills.

In the embodiment explained above, the reject store 60 is provided in the lower bill mechanism 1*b*. However, as shown in the diagram of FIG. 5, the reject store 60 may be provided in the upper bill mechanism 1*a*.

In this case, it is advisable to divide the conveying path 56 of the above embodiment into the conveying paths 56*a* and 56*b*, and connect a connecting portion of the conveying paths 56*a* and 56*b* to the reject store 60. It is advisable to arrange the reject store 60 in a position behind the bill discriminating portion 30.

Even in this case, it is possible to obtain the same operations and effects as those in Embodiment 1.

Figure 5:
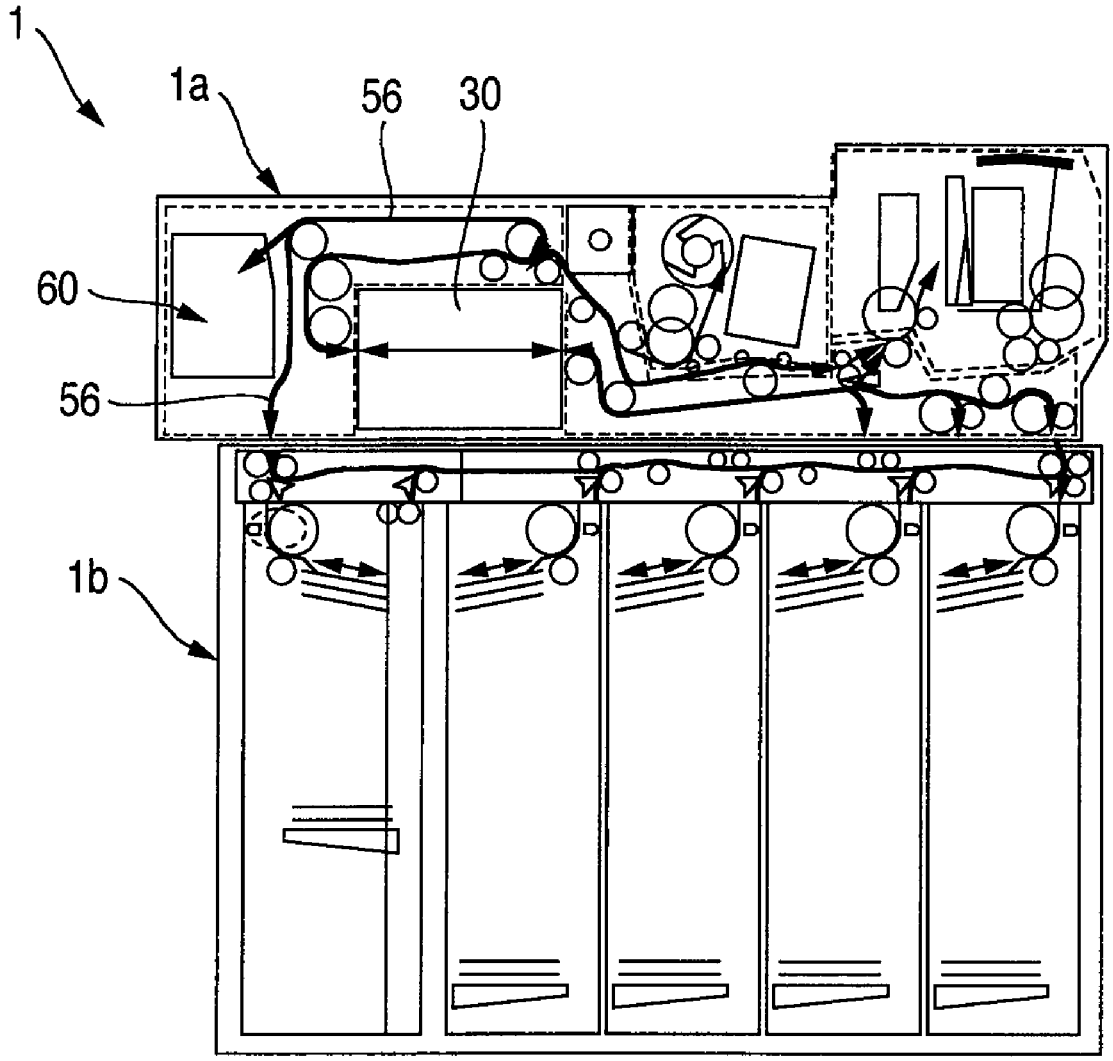
FIG. 5 is a side view showing a configuration of a bill handling device according to another embodiment.

If the bidirectional annular conveying path including the bill discriminating portion is provided and the reject store 60 and the recycle stores 71 to 74 are arranged around the conveying path in this way, it is easily performed to change a position of the reject store 60 as shown in FIG. 5. Therefore, it is possible to change a mounting position without substantially changing the entire configuration. It is also easy to change the configuration according to a demand for device mounting.

The present invention is not limited to the configuration of the embodiment explained above. It is possible to obtain a large number of embodiments.

The invention claimed is:

1. A bill handling device comprising:

a bill discriminating portion which discriminates bills;

a bill storing portion which can receive bills and supply the bills therefrom;

a temporary storage portion which temporarily stores bills during a receipt process;

an operational reject store that stores operational reject bills rejected by the bill discriminating portion during receipt and dispensing processes;

a bill loading portion which loads bills to, and collects bills from, the bill storing portion, the bill loading portion including a loading reject store for storing loading reject bills rejected by the bill discriminating portion during a loading process; and a circular conveying path for conveying bills to said respective portions, wherein:

the circular conveying path is formed so that its start point and end point are joined at a point, and bills can be conveyed through the bill discriminating portion in both directions, the bill storing portion, the temporary storage portion, the bill loading portion, and the operational reject store are arranged along and connected to the circular conveying path, the circular conveying path is adapted to convey bills in a single direction from the bill loading portion to the bill storing portion or the loading reject store through the bill discriminating or process, the circular conveying path comprises respective branching and merging portions for the bill storing portion, the temporary storage portion, the bill loading portion and the operational reject store, and the branching and merging portions comprise:

an operational reject branching and merging portion which can branch bills conveyed along the circular conveying path both in a first conveying direction for a collecting process and a second conveying direction for the loading process, when the bills are conveyed to the operational reject store; and a loading reject branching and merging portion which can branch bills conveyed along the circular conveying path at least in the second conveying direction, when the bills are conveyed to the loading reject store.

* * * * *